US011274263B2

(12) United States Patent
Schmitz et al.

(10) Patent No.: US 11,274,263 B2
(45) Date of Patent: Mar. 15, 2022

(54) HYBRID GREASE WITH LOW FRICTION COEFFICIENTS AND HIGH WEARING PROTECTION

(71) Applicant: Klüber Lubrication München SE & Co. KG, Munich (DE)

(72) Inventors: Reiner Schmitz, Munich (DE); Martin Wimmer, Munich (DE); Stefan Seemeyer, Munich (DE)

(73) Assignee: Klüber Lubrication München SE & CO. KG, Munich (DE)

( * ) Notice: Subject to any disclaimer, the term of this patent is extended or adjusted under 35 U.S.C. 154(b) by 0 days.

(21) Appl. No.: 16/770,280

(22) PCT Filed: Jul. 12, 2019

(86) PCT No.: PCT/EP2019/000215
§ 371 (c)(1),
(2) Date: Jun. 5, 2020

(87) PCT Pub. No.: WO2020/020476
PCT Pub. Date: Jan. 30, 2020

(65) Prior Publication Data

US 2021/0171856 A1 Jun. 10, 2021

(30) Foreign Application Priority Data

Jul. 24, 2018 (DE) ..... 10 2018 005 835.3

(51) Int. Cl.
*C10M 169/02* (2006.01)
*C10M 107/08* (2006.01)
(Continued)

(52) U.S. Cl.
CPC ..... *C10M 169/02* (2013.01); *C10M 107/08* (2013.01); *C10M 107/50* (2013.01);
(Continued)

(58) Field of Classification Search
CPC ..... C10M 169/02; C10M 107/08; C10M 117/02; C10M 107/50; C10M 2229/0415;
(Continued)

(56) References Cited

U.S. PATENT DOCUMENTS

2015/0232782 A1* 8/2015 Fisher ..... C10M 169/042 508/208
2015/0315509 A1* 11/2015 Watanabe ..... C10M 129/26 508/525

FOREIGN PATENT DOCUMENTS

CN 101870905 A * 10/2010
JP 2013199563 A * 10/2013
WO WO-2008037885 A2 * 4/2008 ..... C10M 169/06

OTHER PUBLICATIONS

Lubrication Properites of Polyalphaolefin and Polysiloxane Lubricnats Molecular Structure Tribology Relationshps Zolper Li Chen Jungk Marks Chung Wang Tribol. Lett (2012) 48:355-365 (Year: 2012).*

* cited by examiner

*Primary Examiner* — Pamela H Weiss
(74) *Attorney, Agent, or Firm* — Maginot, Moore & Beck, LLP

(57) ABSTRACT

A hybrid grease is provided having low coefficients of friction and high wear protection which is employable over a wide temperature range. The hybrid grease includes a combination of a grease based on a silicone oil in conjunction with a grease based on synthetic hydrocarbon oils, mineral oils or polyglycols. The hybrid grease may especially be used to lubricate joints in vehicle parts based on plastic-steel pairings.

7 Claims, 2 Drawing Sheets

(51) Int. Cl.
*C10M 107/50* (2006.01)
*C10M 117/02* (2006.01)
*C10N 50/10* (2006.01)

(52) U.S. Cl.
CPC ... *C10M 117/02* (2013.01); *C10M 2205/0265* (2013.01); *C10M 2207/1265* (2013.01); *C10M 2229/0415* (2013.01); *C10N 2050/10* (2013.01)

(58) Field of Classification Search
CPC .. C10M 2205/0265; C10M 2207/1265; C10M 111/04; C10M 2217/045; C10M 2213/062; C10M 2201/066; C10M 2201/0413; C10M 2215/1026; C10M 2207/1285; C10M 2205/003; C10M 2229/0425; C10M 2209/1033; C10M 2205/0285; C10M 2203/1006; C10M 2201/1006; C10N 2050/10; C10N 2010/02; C10N 2040/06; C10N 2040/02; C10N 2070/00; C10N 2030/06; C10N 2030/08; C10N 2030/02; C10N 2040/10
See application file for complete search history.

HYBRID GREASE WITH LOW FRICTION COEFFICIENTS AND HIGH WEARING PROTECTION

This application is a 35 U.S.C 371 National Stage application of PCT/EP2019/000215, filed Jul. 12, 2019 and claiming priority to German Application No. DE 10 2018 005 835.3 filed on Jul. 24, 2018. The entire contents of the above-mentioned patent applications are incorporated herein by reference as part of the disclosure of this U.S. application.

The present invention relates to the provision of a novel hybrid grease having low coefficients of friction and high wear protection which is employable over a wide temperature range. The novel hybrid grease is based on a combination of a grease based on a silicone oil in conjunction with a grease based on synthetic hydrocarbon oils, mineral oils or polyglycols. The novel hybrid grease may especially be used for lubrication of joints in vehicle components based on plastic-steel pairings and also for use in actuators increasingly being used in vehicles, for example in brakes, brake boosters, power steering systems (EPS) and power windows.

Particularly low coefficients of friction which can also be maintained very constantly over a wide temperature range are achieved with a lubricant based on silicone oil. Further improvement of the coefficient of friction and stick-slip behavior requires a high base oil viscosity. Silicone greases, in particular those based on polydimethylsiloxane, have a very high viscosity index and a low pour point. This makes it possible to achieve the abovedescribed properties. However, grease compositions based on silicone oils have weaknesses in terms of wear protection, especially for highly stressed applications, such as for example highly stressed running gear joints.

High wear protection is achieved inter alia with greases based on mineral oils or synthetic hydrocarbons, such as PAOs, esters, polyglycols or PFPEs. In order to cover a wide temperature range base oils having a very high viscosity index and a low pour point are required. Using PFPEs as a base oil is out of the question for many applications on account of its high costs. Even with modern developments in synthetic hydrocarbons, for example m-PAOs (metallocene PAOs), this object is achievable only to a limited extent. Achieving a low coefficient of friction with systems based on synthetic hydrocarbons requires additives, for example PTFE, but this results in very high raw material costs.

WO 2104/028632 A1 discloses lubricant compositions containing as the base oil a silicone-free oil and a silicone oil, wherein the silicone oil is an oil-soluble oil and is selected from ethylsilicone, octylsilicone. Lithium soaps as thickening agents are also mentioned.

U.S. Pat. No. 4,251,431 B describes the production of oils based on PFPE with methylpolysiloxanes as hybrid greases, wherein both oil phases are insoluble.

EP 0 657 524 B1 describes the mixing of PFPE oils with a further PFPE insoluble oil component.

WO 2013/010851 A1 discloses a lubricant composition comprising two constituents, a low-viscosity constituent together with a high-viscosity constituent which is separable from the low-viscosity constituent at low temperatures and becomes uniform at high temperatures.

The known hybrid greases relate to the blending of PFPE greases or oils with other PFPE-free lubricating greases and also to immiscible compositions.

SUMMARY

The present invention accordingly has for its object to provide a lubricant composition which meets the abovementioned requirements and is especially applicable in a wide temperature range from −50° C. to +160° C. and results in low coefficients of friction and long lifetimes and substantially no signs of wear in the components.

To this end the invention provides a hybrid grease consisting of a mixture of a grease based on a silicone oil with a grease or oil based on a synthetic hydrocarbon oil, mineral oil or polyglycol oil and a thickener and customary additives. It is essential that the two base oils/oil phases are not miscible with one another.

The reference "Synthetic Lubricants and High Performance Functional fluids" (Editor R. L. Shubkin), Marcel Dekker Inc, New York, Basel, Hong Kong 1993, ISBN 0-8247-8715-3 contains information regarding typical PAOs (p. 1 to 40), silicone oils (p. 183 to 203) and polyglycols (p. 101 to 123). Metallocene-catalyzed PAOs were presented for example by ExxonMobil in the context of a paper presentation ("The influence of Molecular Structure on the Properties of Polyalphaolefins", Bruce Harrington, Sandy Reid-Peters) at the 19th international tribology colloquium in Esslingen (21 to 23 Jan. 2014).

Ullmanns Encyklopadie der technischen Chemie, 4th revised and extended edition, Verlag Chemie, 1981, volume 20, likewise contains in the article "Schmierstoff and verwandte Produkte" (page 457 to 671) by D. Klamman information about silicone oils (p. 523 to 525). The viscosity of the oils may be from 18 $mm^2/s$ to 20 000 $mm^2/s$ at 40° C.

It is not normally possible to mix a silicone oil with a synthetic hydrocarbon oil. However, it has been found that, surprisingly, it is possible to mix greases based on immiscible base oils, for example polydimethylsiloxane as the silicone oil and, for example, PAO as the synthetic hydrocarbon. These may be mixed to afford a homogeneous lubricant. It is also possible to produce a batch comprising silicone oil as the base oil and a thickener and add the synthetic hydrocarbon oil as the mixing component analogously to an additive. It is likewise possible to produce a batch comprising synthetic hydrocarbon oil as the base oil and a thickener and only add the silicone oil as the mixing component analogously to an additive. The mixture may be manufactured using stirrers such as are prior art in the production of lubricating greases. Mixing may be followed by a subsequent homogenization process step, for example using a milling apparatus (colloid mill), roller apparatus or high-pressure homogenizer.

The resulting lubricant exhibits all of the properties recited as required and desirable hereinabove.

The silicone oil is selected from the group consisting of polydimethylsiloxane, polyphenylmethylsiloxane or mixtures of both oils. The synthetic hydrocarbon oil is selected from the group consisting of PAO, mixtures of PAO and olefin copolymers, mixtures of PAO and polyisobutylene. The thickener is selected from the group of non-soap thickeners, for example ureas, and soap thickeners, such as complex and simple soap thickeners, especially preferably lithium 12-hydroxystearate, lithium stearate.

The hybrid grease according to the invention may further contain customary additives such as antioxidants, anticorrosion agents and a solid lubricant.

Production of the hybrid grease according to the invention comprises mixing (A) 10% to 50% by weight of a grease based on a synthetic hydrocarbon oil, mineral oil or polyglycol containing 50% to 90% by weight of base oil selected from synthetic hydrocarbon oil, PAO, mineral oil or polyglycol, 10% to 25% by weight of thickener, 0% to 10% by weight of additives, with (B) 50 to 90% by weight of a silicone grease containing 70% to 90% by weight of silicone oil, 5% to 30% by weight of thickener and up to 0% to 10% by weight of additives.

The component (A) may optionally contain 0% to 50% by weight of solid lubricant. Solid lubricants may be for example PTFE, graphite, molybdenum disulfide, melamine cyanurate and mixtures thereof.

Production of the hybrid grease according to the invention especially preferably comprises mixing (A) 10% to 20% by weight of a grease containing 70% to 90% by weight of base oil selected from synthetic hydrocarbon oil, mineral oil or polyglycol, 10% to 20% by weight of thickener, 1% to 7% by weight of additives, with (B) 80 to 90% by weight of a silicone grease containing 70% to 80% by weight of polydimethylsiloxane, up to 30% by weight of thickener and 1% to 10% by weight of additives.

Particular preference is given to a hybrid grease in which PAO, mPAO, ethylene, LAO copolymers are used as synthetic hydrocarbons.

DETAILED DESCRIPTION

Figure 1:
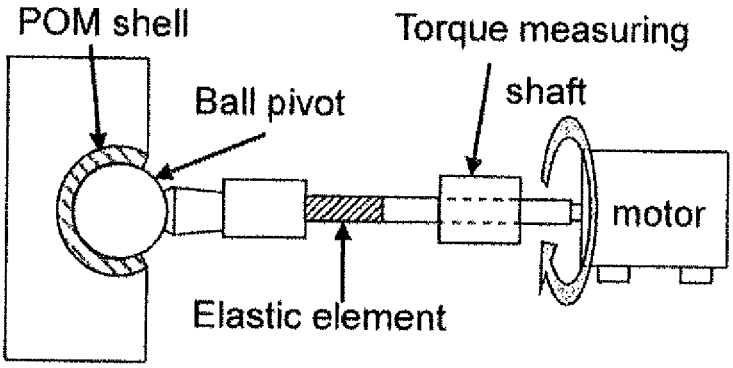
FIG. 1 shows the setup of an apparatus for determining the coefficients of friction by means of a torque test in a ball joint.
Figure 2:
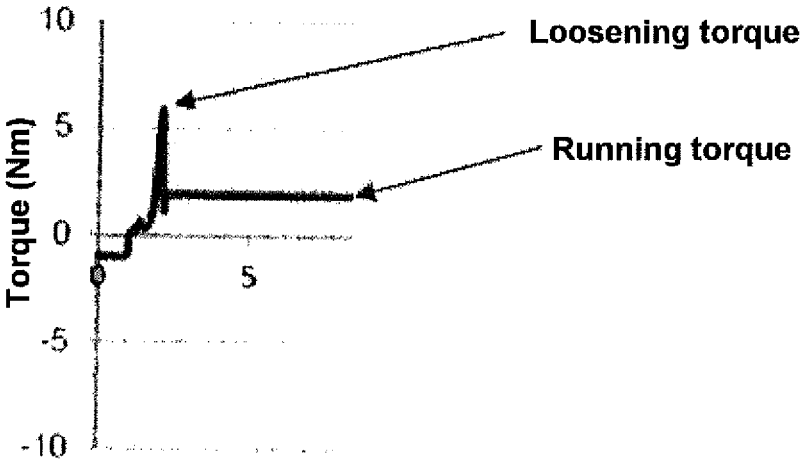
FIG. 2 shows by way of example the course over time of the measurement from the apparatus in FIG. 1.

The invention is now more particularly elucidated by the following examples.

EXAMPLES

Production:

A standard production process according to the prior art for lubricating greases was employed.

The base oil/a portion of the base oil or oil mixture is initially charged in a suitable heatable container comprising a stirrer such as is used in the prior art for the production of lubricating greases. Production of the thickener is carried out therein, for example neutralization of stearic acid or 12-OH-stearic acid with lithium hydroxide and a subsequent heating phase for removing the water and for forming the thickener structure. Peak temperatures of up to 210° C. may be achieved to completely melt the soap thickener and subsequently adjust the morphology of the thickener by targeted cooling. The additives are added and homogeneously distributed in the subsequent cooling phase. It is also possible to produce a batch comprising silicone oil as the base oil and a thickener and add the synthetic hydrocarbon oil as the mixing component analogously to an additive. It is likewise possible to produce a batch comprising synthetic hydrocarbon oil as the base oil and a thickener and only add the silicone oil as the mixing component analogously to an additive. This is followed by a homogenization process, for example using a roller apparatus or a colloid mill or a high-pressure homogenizer such as is customary according to the prior art for the production of lubricating greases.

The grease components (A) and (B) shown in Table 1 were produced according to the procedure described above. All reported amounts are in % by weight.

TABLE 1

| | Synth. HC/PAO grease A | Synth. HC/PAO grease B | Silicone grease |
|---|---|---|---|
| Polydimethylsiloxane Viscosity at 40° C. 10000 $mm^2/s$ | — | — | 75% |
| Synth. HC/PAO Viscosity at 40° C. 3500 $mm^2/s$ | — | 80.5% | — |
| Synth. HC/PAO Viscosity at 40° C. 350 $mm^2/s$ | 74% | — | — |
| Thickener: lithium 12-OH-stearate/lithium stearate | 20% | 13% | 24% |
| Antioxidant | 1% | 0.5% | — |
| Anticorrosion agent | 5% | 1% | 1% |
| Solid lubricant | — | 5% | — |

Hybrid Greases:

The mixture of the two greases may be manufactured using stirrers such as are prior art in the production of lubricating greases. It is also possible to produce a batch comprising silicone oil as the base oil and a thickener and add the synthetic hydrocarbon oil as the mixing component analogously to an additive. It is likewise possible to produce a batch comprising synthetic hydrocarbon oil as the base oil and a thickener and only add the silicone oil as the mixing component analogously to an additive. Mixing may be followed by a subsequent homogenization process step, for example using a milling apparatus (colloid mill), roller apparatus or high-pressure homogenizer.

The hybrid greases according to the invention were produced from the components (A) and (B) shown in Table 2 by this process. All reported amounts are in % by weight.

TABLE 2

| | Hybrid grease A | Hybrid grease B | Hybrid grease C |
|---|---|---|---|
| Synth. HC/PAO grease A | 20% | — | — |
| Synth. HC/PAO grease B | — | 20% | 10% |
| Silicone grease | 80% | 80% | 90% |

Determination of Coefficients of Friction

To determine the coefficients of friction by means of a torque test in a ball joint the test method described hereinbelow was used. The setup of the test apparatus is shown in FIG. 1.

Ball joints such as are standard-fit in the running gear of vehicles were used. The balls are made of steel with a diameter of 23 mm. The steel ball is enclosed by a plastic cup made of POM (polyoxymethylene). The lubricant is introduced between the plastic cup and the steel ball. The POM cup with the ball is then introduced into a housing by positive attachment. The housing is compressed such that a certain force is exerted on the system composed of the cup and ball. In the present example the pressure is about 1 $N/mm^2$.

Table 3 shows the results of the determination of the coefficients of friction by means of a torque test.

TABLE 3

| Sample | Synth. HC/PAO grease A | Synth. HC/PAO grease B | Silicone grease | Hybrid grease A | Hybrid grease B | Hybrid grease C |
|---|---|---|---|---|---|---|
| Loosening torque at +25° C. | 6 Nm | 5.8 Nm | 3.2 Nm | 5 Nm | 3.2 Nm | 3.1 Nm |
| Loosening torque at −40° C. | 3.9 Nm | 3.2 Nm | 2.7 Nm | 3.6 Nm | 2.7 Nm | 2.6 Nm |
| Loosening torque at +80° C. | 5.5 Nm | 5.7 Nm | 3.2 Nm | 5.4 Nm | 3.2 Nm | 3.1 Nm |
| Running torque at +25° C. | 2.5 Nm | 1.6 Nm | 1.8 Nm | 1.8 Nm | 1.6 Nm | 1.6 Nm |
| Running torque at −40° C. | 2.7 Nm | 2.0 Nm | 0.9 Nm | 0.6 Nm | 0.8 Nm | 0.8 Nm |
| Running torque at +80° C. | 3 Nm | 2.5 Nm (stick slip) | 2.3 Nm | 2.6 Nm | 2.3 Nm | 2.2 Nm |

Compared to the greases based on synthetic hydrocarbons hybridization had a positive effect on loosening and running torque. The low loosening torques and running torques of silicone grease over the entire temperature range were particularly advantageously achieved and in some cases even exceeded, i.e. lowered, with hybrid greases B and C in particular.

Determination of Wear Protection

The wear test was performed in a ball joint.

The described ball joint is subjected using an apparatus to a load of 3240 N. The apparatus is movably mounted so that the ball may be tilted in the POM cup. The tilting motion is performed with a deflection of 3° and a frequency of 15 Hz. The motion is halted at regular intervals and the play resulting from wear was determined by unloading and reversal of the load.

Figure 3:
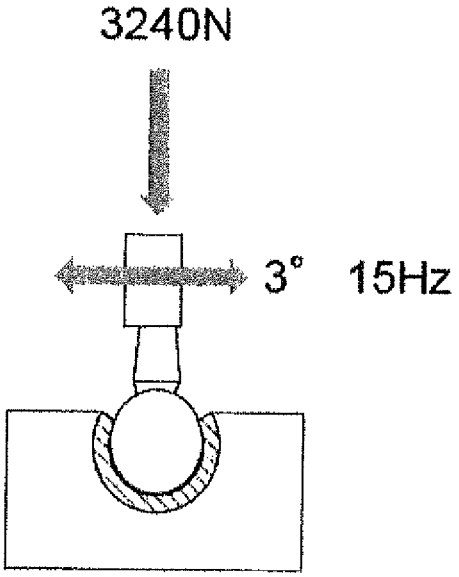
FIG. 3 shows the apparatus for determining wear protection using a wear protection test in a ball joint.

The setup of the apparatus for wear protection testing is shown in FIG. 3.

The result of the wear test is shown in Table 4.

The wear distance of the joint was evaluated after 1.1 million load cycles

TABLE 4

| Sample | Synth. HC/PAO grease A | Synth. HC/PAO grease B | Silicone grease | Hybrid grease A | Hybrid grease B | Hybrid grease C |
|---|---|---|---|---|---|---|
| Wear distance (mm) | 0.25 mm | 0.15 mm | >0.65 mm | 0.4 mm | 0.2 mm | 0.3 mm |

Hybridization had a positive effect on wear values compared to silicone grease Hybrid grease B in particular achieved a very good wear level.

The invention claimed is:

1. A hybrid grease consisting of:

(A) 10% to 20% by weight of a grease based on a synthetic hydrocarbon oil, mineral oil or polyglycol containing 70% to 80% by weight of a base oil selected from synthetic hydrocarbon oil, PAO, mineral oil and polyglycol, 10% to 20% by weight of thickener, 1% to 7% by weight of additives, and (B) 80 to 90% by weight of a silicone grease containing 70% to 80% by weight of a silicone oil selected from the group consisting of polydimethylsiloxane, polyphenylmethylsiloxane and mixtures thereof, 10% to 30% by weight of thickener and 1% to 10% by weight of additives.

2. A method of using the hybrid grease as claimed in claim 1, comprising applying the hybrid grease to a joint in the vehicle sector for the lubrication of the joint.

3. The method of using the hybrid grease as claimed in claim 2 wherein the joint being lubricated is based on plastic and steel pairings.

4. A method of using the hybrid grease as claimed in claim 1, comprising applying the hybrid grease to an actuator for the lubrication of the actuator.

5. A method of producing the hybrid grease as claimed in claim 1, comprising:

mixing the component (A) grease and the component (B) grease, and subsequent homogenization of the mixture.

6. The method of claim 4, wherein the actuator being lubricated is selected from the group consisting of: vehicle power steering systems (EPS), brake actuators, brake boosters, and power windows.

7. The hybrid grease as claimed in claim 1, wherein the synthetic hydrocarbon oil is an oil selected from the group consisting of PAO, mixtures of PAO and olefin copolymers, mixtures of PAO and polyisobutylene.

* * * * *